US009302803B1

(12) United States Patent
Thompson

(10) Patent No.: US 9,302,803 B1
(45) Date of Patent: Apr. 5, 2016

(54) EMPTYING SYSTEM FOR A COLOSTOMY BAG

(71) Applicant: Zonk Terry Wayne Thompson, Atascadero, CA (US)

(72) Inventor: Zonk Terry Wayne Thompson, Atascadero, CA (US)

( * ) Notice: Subject to any disclaimer, the term of this patent is extended or adjusted under 35 U.S.C. 154(b) by 72 days.

(21) Appl. No.: 14/301,015

(22) Filed: Jun. 10, 2014

(51) Int. Cl.
*B65B 69/00* (2006.01)

(52) U.S. Cl.
CPC ..... *B65B 69/0016* (2013.01)

(58) Field of Classification Search
USPC ..... 222/1, 94, 102, 272, 410, 175, 130, 131
See application file for complete search history.

(56) References Cited

U.S. PATENT DOCUMENTS 2,496,175 A * 1/1950 Murle ..... A61F 5/445 604/335
3,897,780 A * 8/1975 Trousil ..... A61F 5/445 604/344
4,639,251 A * 1/1987 Kirkland ..... A61J 1/10 116/227
4,642,106 A * 2/1987 Downey ..... A61F 5/44 600/573
5,199,602 A * 4/1993 Drew ..... B65D 81/3261 222/1
5,423,782 A * 6/1995 Wolrich ..... A61F 5/445 604/339
5,429,626 A * 7/1995 Fenton ..... A61F 5/448 604/339
2005/0218154 A1* 10/2005 Selsby ..... A61F 5/44 222/94
2013/0181006 A1* 7/2013 Rondeau ..... A61F 5/4404 222/102
2014/0276500 A1* 9/2014 Scott ..... A61F 5/449 604/343

* cited by examiner

*Primary Examiner* — Donnell Long
(74) *Attorney, Agent, or Firm* — Plager Schack LLP

(57) ABSTRACT

An emptying system is configured to remove matter from a colostomy bag. The emptying system includes a clamping device that is configured to apply pressure to both sides of the colostomy bag and to squeeze the matter out of the colostomy bag. An outer bag is attached to the clamping device such that the outer bag receives the matter from the colostomy bag and is configured to cover the clamping device.

8 Claims, 4 Drawing Sheets

EMPTYING SYSTEM FOR A COLOSTOMY BAG

BACKGROUND

The embodiments herein relate generally to systems that assist a user with a colostomy bag.

Prior to embodiments of the disclosed invention, it was difficult and unsanitary to remove waste from a colostomy bag. Embodiments of the disclosed invention solve this problem.

SUMMARY

An emptying system is configured to remove matter from a colostomy bag. The emptying system includes a clamping device that is configured to apply pressure to both sides of the colostomy bag and to squeeze the matter out of the colostomy bag. An outer bag is attached to the clamping device such that the outer bag receives the matter from the colostomy bag and is configured to cover the clamping device.

In some embodiments, the clamping device can further include a knobbed bracket connected to a first roller with a first shaft. A knob can be mechanically coupled to the first shaft. The knob can further comprise a knob gear that turns as the knob is turned. A gear bracket can be connected to the knobbed bracket with a live hinge. A second shaft can be mechanically coupled to the gear bracket. A second roller can be attached to the second shaft. A gear can be attached to the second shaft such that the gear can be turned by the knob gear when the knobbed bracket is immediately adjacent to the gear bracket.

In some embodiments, the first roller can be covered in a first roller front band and a first roller rear band. The second roller can be covered in second roller front band and second roller rear band. The first roller front band can be aligned with the second roller front band and the first roller rear band can be aligned with the second roller rear band such that the first roller, when rotated, turns the second roller without excessive torsion building up in the gear.

In some embodiments a clip can be mechanically coupled to the knobbed bracket. A lock nub can be mechanically coupled to the gear bracket. The knobbed bracket can be configured to be detachably coupled to the gear bracket by inserting the clip into the lock nub.

In some embodiments, a front outer bag adherence flap and a rear outer bag adherence flap can be mechanically coupled to the outer bag. A front outer bag tape can be mechanically coupled to the front outer bag adherence flap. A rear outer bag tape can be mechanically coupled to the rear outer bag adherence flap. Attaching the front outer bag tape and the rear outer bag tape to the clamping device can be effective for removing the matter from the colostomy bag into the outer bag.

In some embodiments, a front outer bag fold can be attached to an outer bag front side on the outer bag. A rear outer bag fold can be attached to an outer bag rear side on the outer bag. The front outer bag fold attached and the rear outer bag fold attached are configured to cover the clamping device.

A process for emptying a colostomy bag without spilling the matter outside of an emptying system comprises the following steps. First, separating a knobbed bracket a from gear bracket. The knobbed bracket and the gear bracket are connected at one end with a live hinge forming a clamping device. Next, placing the colostomy bag between a first roller attached to the knobbed bracket and a second roller attached to the gear bracket. Then, locking the knobbed bracket to the gear bracket with a clip attached to the knobbed bracket and a lock nub attached to the gear bracket. After that, turning a knob attached to a knob gear on a first shaft attached to the first roller; wherein the knob gear is attached to a gear on a second shaft attached to the second shaft such that turning the knob turns the first shaft toward the second shaft squeezing matter from the colostomy bag.

In some embodiments the process can further include affixing the clamping device to a front outer bag adherence flap and a rear outer bag adherence flap with a front outer bag tape and a rear outer bag tape. Finally, covering the clamping device and the colostomy bag with a rear outer bag fold over flap attached to the outer bag and front outer bag fold over flap attached to the outer bag.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
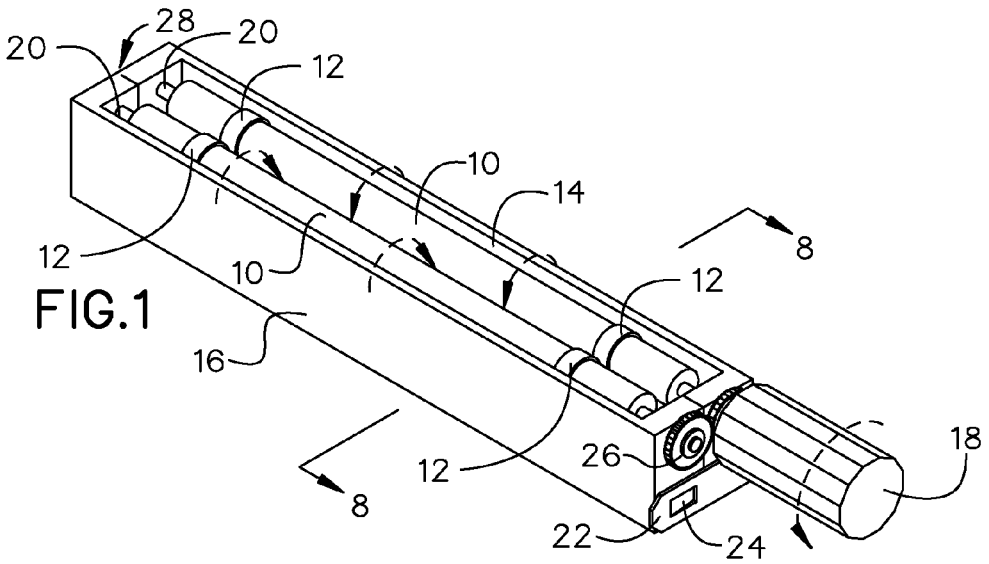
FIG. 1 is a perspective view of an embodiment of the invention.
Figure 2:
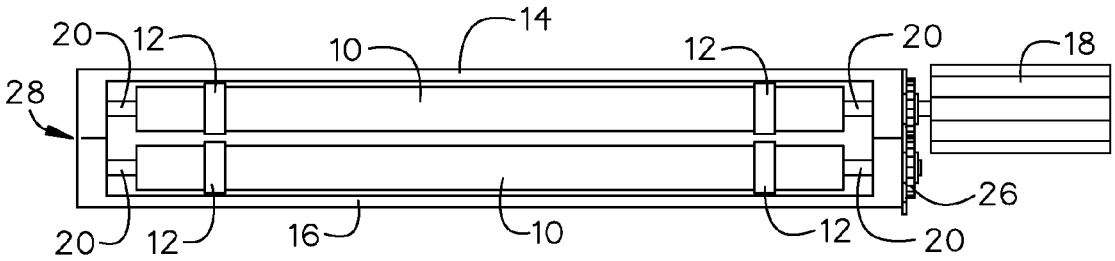
FIG. 2 is a top view of an embodiment of the invention.

By way of example, and referring to FIG. 1 and FIG. 2, one embodiment the emptying system includes a clamping device configured to apply pressure to both sides of a colostomy bag. The clamping device comprises first roller 10 covered in first roller front band 12 and first roller rear band 12. First roller 10 is connected to knobbed bracket 14 with first shaft 20. First shaft 20 is mechanically coupled to knob 18 at one distal point. Knob 18 further comprises a knob gear that turns as knob 18 is turned. Knobbed bracket 14 is further mechanically coupled to clip 22. Knobbed bracket 14 takes the shape of a quarter of an open parallelepiped.

Knobbed bracket 14 is connected to gear bracket 16 with live hinge 28. Gear bracket 16 likewise takes the shape of a quarter of an open parallelepiped. Gear bracket 16 is mechanically coupled to second shaft 20. Second shaft 20 is attached to second roller 10. Second roller 10 is covered in second roller front band 12 and second roller rear band 12. Second shaft 20 is mechanically coupled to gear 26 at one distal point. Gear bracket 16 is further mechanically coupled to lock nub 24. The bands can be rubber bands.

Figure 3:
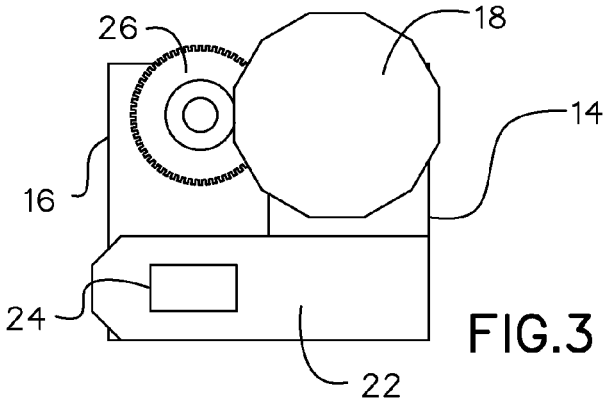
FIG. 3 is a side view of an embodiment of the invention.

Turning to FIG. 3, lock nub 24 can be inserted into clip 22 to connect knobbed bracket 14 to gear bracket 16. At that point, first roller front band 12 is immediately adjacent to second roller front band 12 and first roller rear band 12 is immediately adjacent to second roller rear band 12. This causes friction between first roller 10 and second roller 10 such that first roller 10 and second roller 10 turn simultaneously without excessive torsion accumulating on second shaft 20 proximate gear 26. As used in this application excessive torsion is more than two pound-feet.

Figure 4:
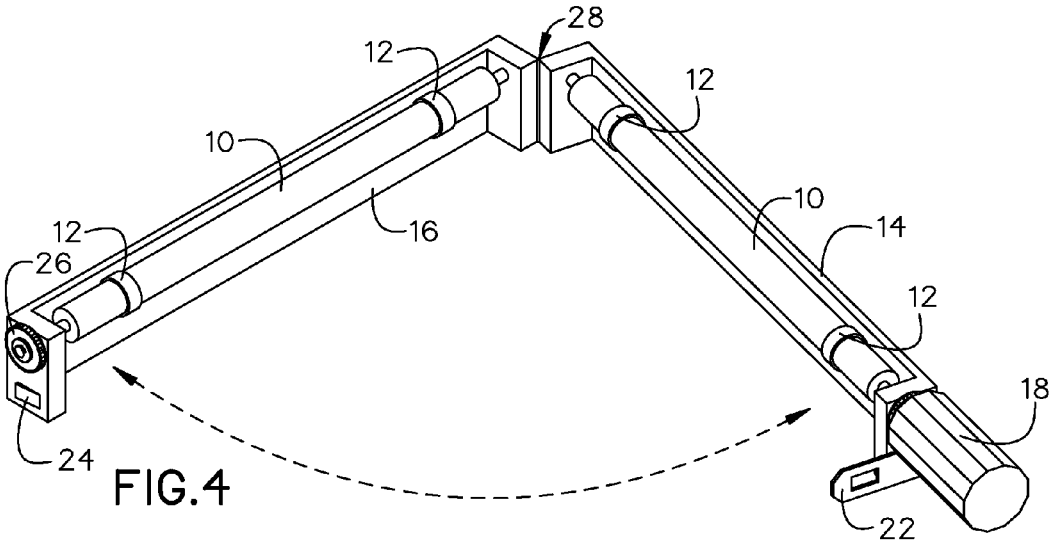
FIG. 4 is a perspective view of an embodiment of the invention shown in open configuration.
Figure 5:
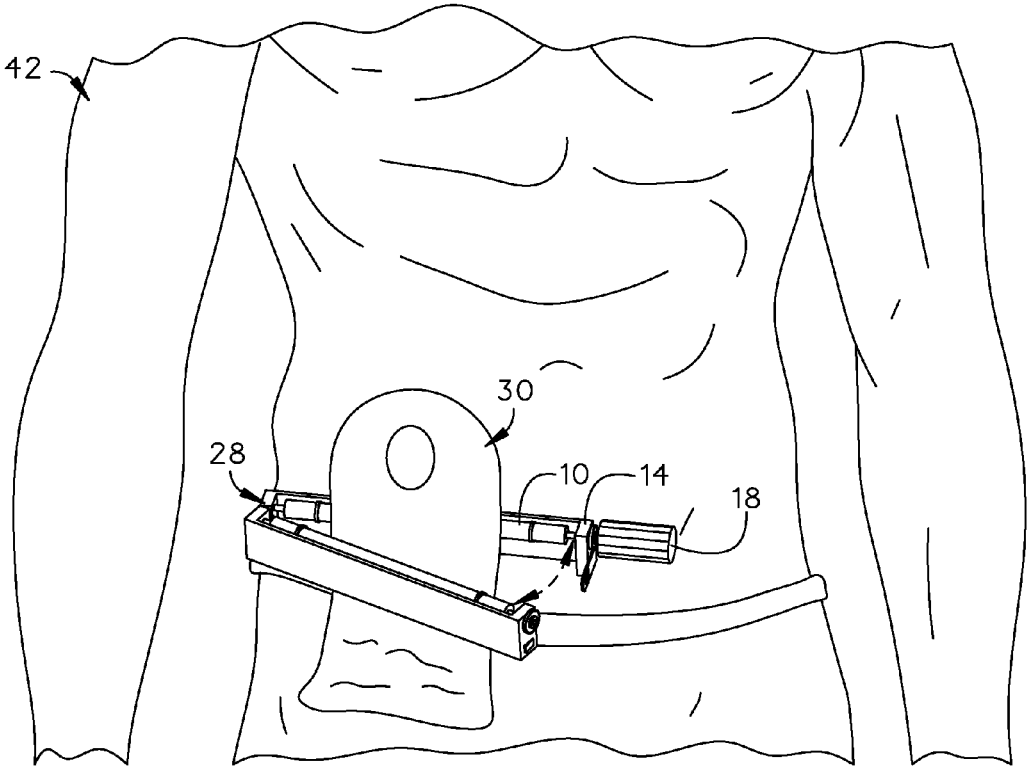
FIG. 5 is a perspective view of an embodiment of the invention shown in application stage.

FIG. 4 and FIG. 5 provide one theory of operation, wherein human user 42 separates knobbed bracket 14 from gear bracket 16. Next, human user 42 places colostomy bag 30 between first roller 10 and second roller 10. After that, human user 42 locks knobbed bracket 14 to gear bracket 16 with clip 22 and lock nub 24.

Figure 6:
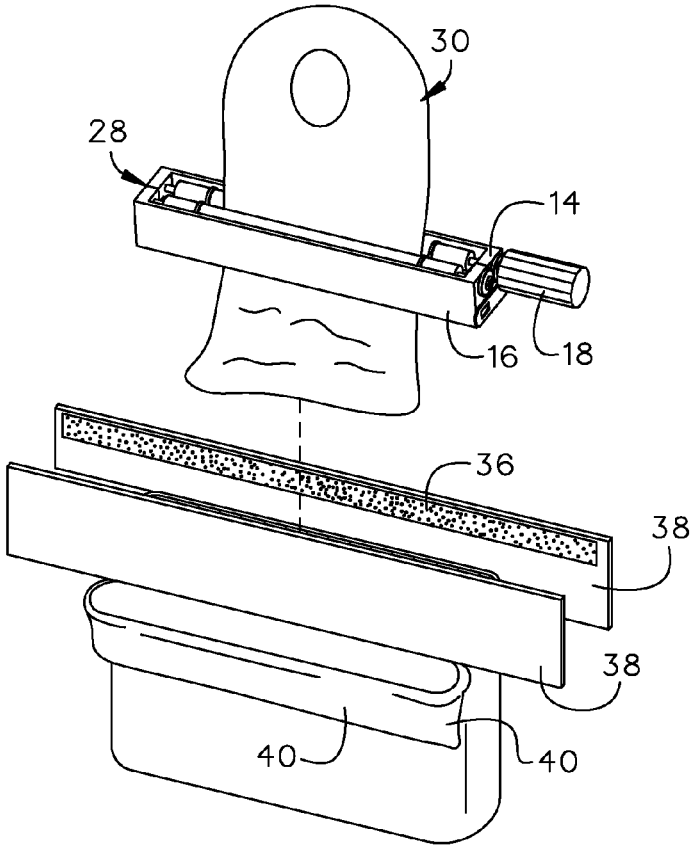
FIG. 6 is an exploded view demonstrating application of the outer bag.
Figure 7:
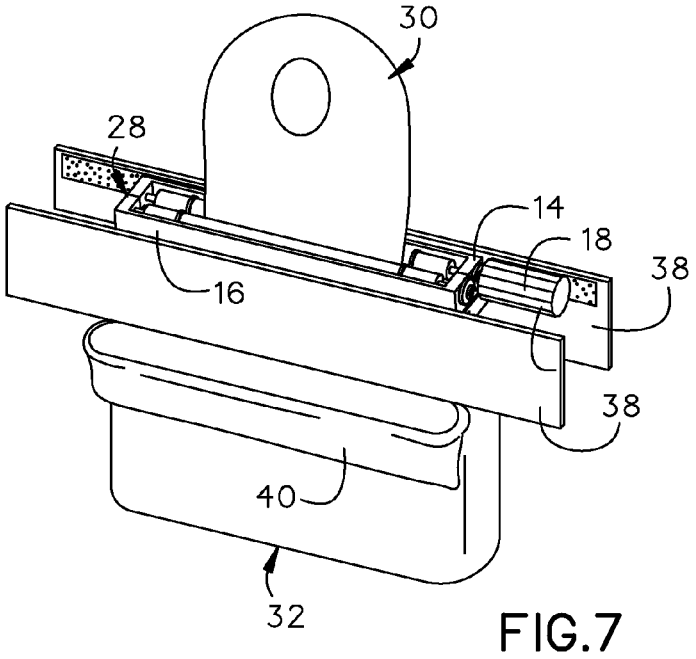
FIG. 7 is a perspective view demonstrating post application of the outer bag.
Figure 8:
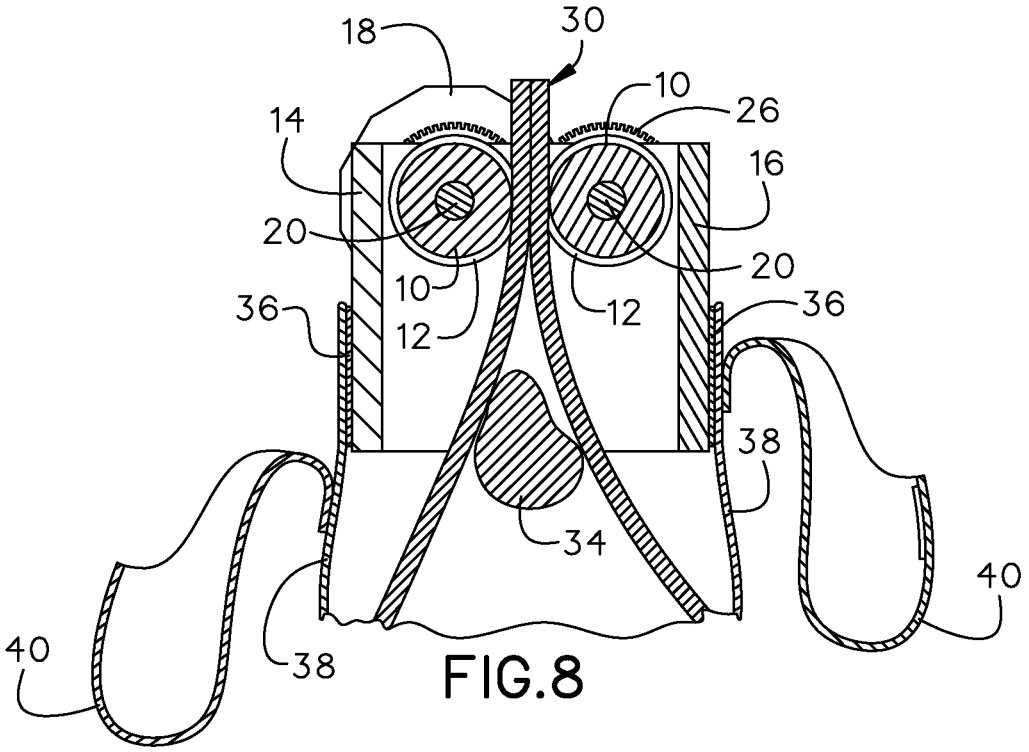
FIG. 8 is a section view of an embodiment of the invention along line 8-8 in FIG. 1 demonstrated with outer bag attachment and in use.
Figure 9:
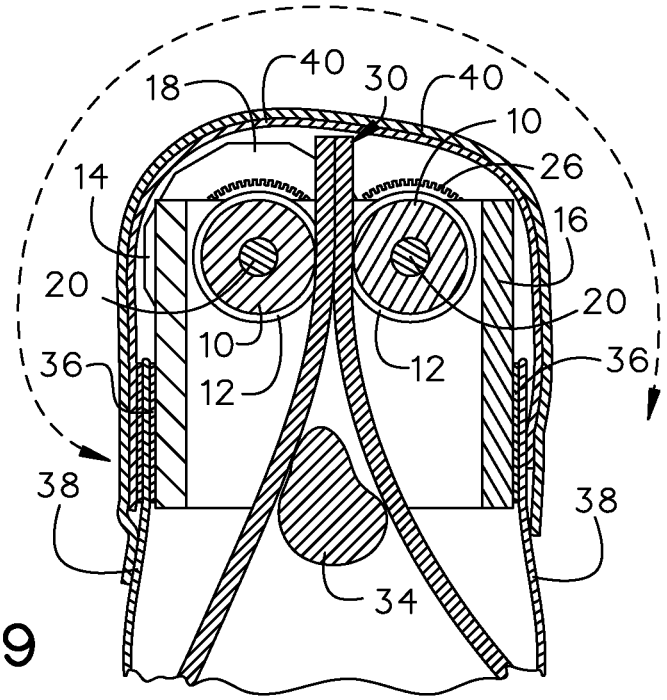
FIG. 9 is a section view of an embodiment of the invention demonstrating fold over of the outer bag fold over flap.

FIG. 6 and FIG. 7 show an additional theory of operation using outer bag 32. Outer bag 32 is mechanically coupled to front outer bag adherence flap 38 and rear outer bag adherence flap 38. Front outer bag adherence flap 38 is mechanically coupled to front outer bag tape 36. Likewise, rear outer bag adherence flap 38 is mechanically coupled to rear outer bag tape 36. An outer bag front side on outer bag 32 is mechanically coupled to front outer bag fold over flap 40. Similarly, an outer bag rear side on outer bag 32 is mechanically coupled to rear outer bag fold over flap 40.

To use outer bag 32, as shown in FIG. 6, FIG. 7, FIG. 8 and FIG. 9, the clamping device is affixed to front outer bag adherence flap 38 and rear outer bag adherence flap 38 with front outer bag tape 36 and rear outer bag tape 36. Then, user 42 turns knob 18 to drive matter 34 from colostomy bag 30 into outer bag 32. After this, the clamping device and the colostomy bag are covered with rear outer bag fold over flap 40 and front outer bag fold over flap 40.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An emptying system, configured to remove matter from a colostomy bag;

the emptying system comprising:

a clamping device, configured to apply pressure to both sides of the colostomy bag and to squeeze the matter out of the colostomy bag; and an outer bag attached to the clamping device such that the outer bag receives the matter from the colostomy bag and is configured to cover the clamping device.

2. The emptying system of claim 1, wherein the clamping device further comprises:

a knobbed bracket connected to a first roller with a first shaft;

a knob, mechanically coupled to the first shaft; the knob further comprises a knob gear that turns as the knob is turned;

a gear bracket connected to the knobbed bracket with a live hinge;

a second shaft mechanically coupled to the gear bracket;

a second roller attached to the second shaft;

a gear attached to the second shaft such that the gear can be turned by the knob gear when the knobbed bracket is immediately adjacent to the gear bracket.

3. The emptying system of claim 2, wherein:

the first roller is covered in a first roller front band and a first roller rear band;

the second roller is covered in second roller front band and second roller rear band;

wherein the first roller front band is aligned with the second roller front band and the first roller rear band is aligned with the second roller rear band such that the first roller, when rotated, turns the second roller without excessive torsion building up in the gear.

4. The emptying system of claim 2, wherein the clamping device further comprises:

a clip mechanically coupled to the knobbed bracket;

a lock nub mechanically coupled to the gear bracket;

wherein the knobbed bracket is configured to be detachably coupled to the gear bracket by inserting the lock nub into the clip.

5. The emptying system of claim 2, a front outer bag adherence flap and a rear outer bag adherence flap mechanically coupled to the outer bag;

a front outer bag tape mechanically coupled to the front outer bag adherence flap; and a rear outer bag tape mechanically coupled to the rear outer bag adherence flap;

wherein attaching the front outer bag tape and the rear outer bag tape to the clamping device is effective for removing the matter from the colostomy bag into the outer bag.

6. The emptying system of claim 5, a front outer bag fold attached to an outer bag front side on the outer bag;

a rear outer bag fold attached to an outer bag rear side on the outer bag;

wherein the front outer bag fold attached and the rear outer bag fold are configured to cover the clamping device.

7. A process for emptying a colostomy bag without spilling the matter outside of an emptying system comprises the following steps:

separating a knobbed bracket from a gear bracket; wherein the knobbed bracket and the gear bracket are connected at one end with a live hinge forming a clamping device;

placing the colostomy bag between a first roller attached to the knobbed bracket and a second roller attached to the gear bracket;

locking the knobbed bracket to the gear bracket with a clip attached to the knobbed bracket and a lock nub attached to the gear bracket;

turning a knob attached to a knob gear on a first shaft attached to the first roller; wherein the knob gear is attached to a gear on a second shaft attached to the second shaft such that turning the knob turns the first shaft toward the second shaft; and squeezing matter from the colostomy bag into an outer bag.

8. The process of claim 7, further comprising:

affixing the clamping device to a front outer bag adherence flap and a rear outer bag adherence flap with a front outer bag tape and a rear outer bag tape;

covering the clamping device and the colostomy bag with a rear outer bag fold over flap attached to the outer bag and front outer bag fold over flap attached to the outer bag.

* * * * *